US007699196B2

(12) United States Patent
Szabo

(10) Patent No.: US 7,699,196 B2
(45) Date of Patent: Apr. 20, 2010

(54) PROPERTY EVIDENCE BAG

(76) Inventor: Laci Szabo, 1309 N. Central Ave., Flagler Beach, FL (US) 32136

( * ) Notice: Subject to any disclaimer, the term of this patent is extended or adjusted under 35 U.S.C. 154(b) by 987 days.

(21) Appl. No.: 11/359,857

(22) Filed: Feb. 22, 2006

(65) Prior Publication Data

US 2007/0194073 A1 Aug. 23, 2007

(51) Int. Cl.
*B65D 30/10* (2006.01)

(52) U.S. Cl. ..... 224/236; 224/914; 224/674; 224/196; 224/656; 224/676

(58) Field of Classification Search ..... 224/914, 224/674, 236, 656, 672, 196, 676, 681; 383/2, 383/40, 16, 21; 206/69, 494
See application file for complete search history.

(56) References Cited

U.S. PATENT DOCUMENTS 2,060,238 A * 11/1936 Nilson ..... 383/71
3,244,261 A * 4/1966 Herz ..... 190/111
3,587,698 A * 6/1971 Ritter ..... 150/116
3,989,080 A * 11/1976 Koszegi ..... 383/40
4,117,874 A * 10/1978 Berenguer ..... 383/28
5,174,482 A * 12/1992 Rogers et al. ..... 224/239
5,346,311 A * 9/1994 Siler et al. ..... 383/75
5,472,280 A * 12/1995 Rittmaster ..... 383/6
6,632,403 B1 * 10/2003 Barmore et al. ..... 422/102
6,991,373 B2 * 1/2006 Carr et al. ..... 383/111
2003/0223655 A1 * 12/2003 Faygenov ..... 383/63
2005/0056669 A1 * 3/2005 Lavelle ..... 224/153

* cited by examiner

*Primary Examiner*—Nathan J Newhouse
*Assistant Examiner*—John Cogill
(74) *Attorney, Agent, or Firm*—Dennis G. LaPointe

(57) ABSTRACT

A property and evidence bag comprising a deployable inner bag inside a pouch attached typically to the belt of an officer. The inner bag can be deployed and expands from its folded compact state inside the pouch. It is partially attached to the pouch and deploys by pulling a tab. Property and evidence can be placed in the inner bag and its opening can be secured using one hand by pulling on a draw string at its opening. This allows the officer to safely secure property and evidence found during an arrest while at the same time holding the arrestee at bay. After the arrestee is seated in the patrol car, the property and evidence found during the search of the arrestee's pockets can be itemized.

6 Claims, 3 Drawing Sheets

PROPERTY EVIDENCE BAG

FIELD OF THE INVENTION

The invention relates to a convenient device for securing prisoner personal property and evidence such as contraband while a criminal suspect is being searched during an arrest.

BACKGROUND OF THE INVENTION

When a law enforcement officer makes an arrest and handcuffs a criminal suspect behind his or her back, the officer must empty the suspect's pockets before putting him in the back of the police car. This is a mandatory procedure in all jurisdictions.

What actually happens is that the officer will search the suspect's pockets and put the contents, contraband and/or other property, on the hood of the patrol car. If there is any wind, or if the items are small, or if there are numerous items, they will often end up on the ground. In this case, the officer has to bend over near the suspect's feet to retrieve any fallen objects. This in itself creates a safety issue for the officer. The officer cannot let go of the prisoner at any time, especially if he is combative or an escape risk.

If the officer has found contraband and loses it, he is in trouble with the force for having lost the evidence. If for example, the officer places property retrieved from pockets and any contraband evidence on the patrol vehicle hood, and the prisoner decides to be combative, in all probability, the evidence and property will be scattered around the surrounding ground area. Any glass item, like a crack cocaine pipe, will more than likely break. If the prisoner has money, it flies away. It is obvious that the circumstances that can lead to lost property and evidence is enumerable and the consequences can be extremely detrimental to the chances of a successful prosecution against the prisoner.

What is needed is a device that is convenient to use by the police officer and that can be used to secure property and evidence while allowing the officer to maintain control of the prisoner.

SUMMARY OF THE INVENTION

The present invention allows the officer to hold the prisoner with one hand and with the other hand, he can open an outer pouch (also referred to herein as outer bag or container) attached to a convenient location such as a belt. He can then pull a tab connected to an inner foldable pouch to deploy the inner pouch or bag. This foldable bag may also be folded so as to allow its expansion when deployed, that is, when deployed, it is wider than the outer container and significantly deeper than the outer container. With this same hand, he can then search the pockets of the prisoner and place the contents directly into the inner bag. When the pockets are empty, he can secure the inner pouch, typically by pulling on a draw string.

If the prisoner starts to be combative, the property and evidence is safe and secured.

The officer can then place the prisoner in the back of the patrol car, go to the driver's seat, and then open the evidence bag to itemize its contents.

With the invention, there is no loss of property or evidence and no unnecessary risks to the police officer. It is practical and it saves time.

When the process is completed, the foldable inner bag is simply folded and re-inserted into the outer bag with the pull tab at the top of the interior of the outer bag. The outer bag is then re-secured by closing the flap using a snap type of fastener, a clip type of fastener or other securement/fastening means known in the art, such as a hook and loop fastener.

DETAILED DESCRIPTION OF THE INVENTION

Figure 1:
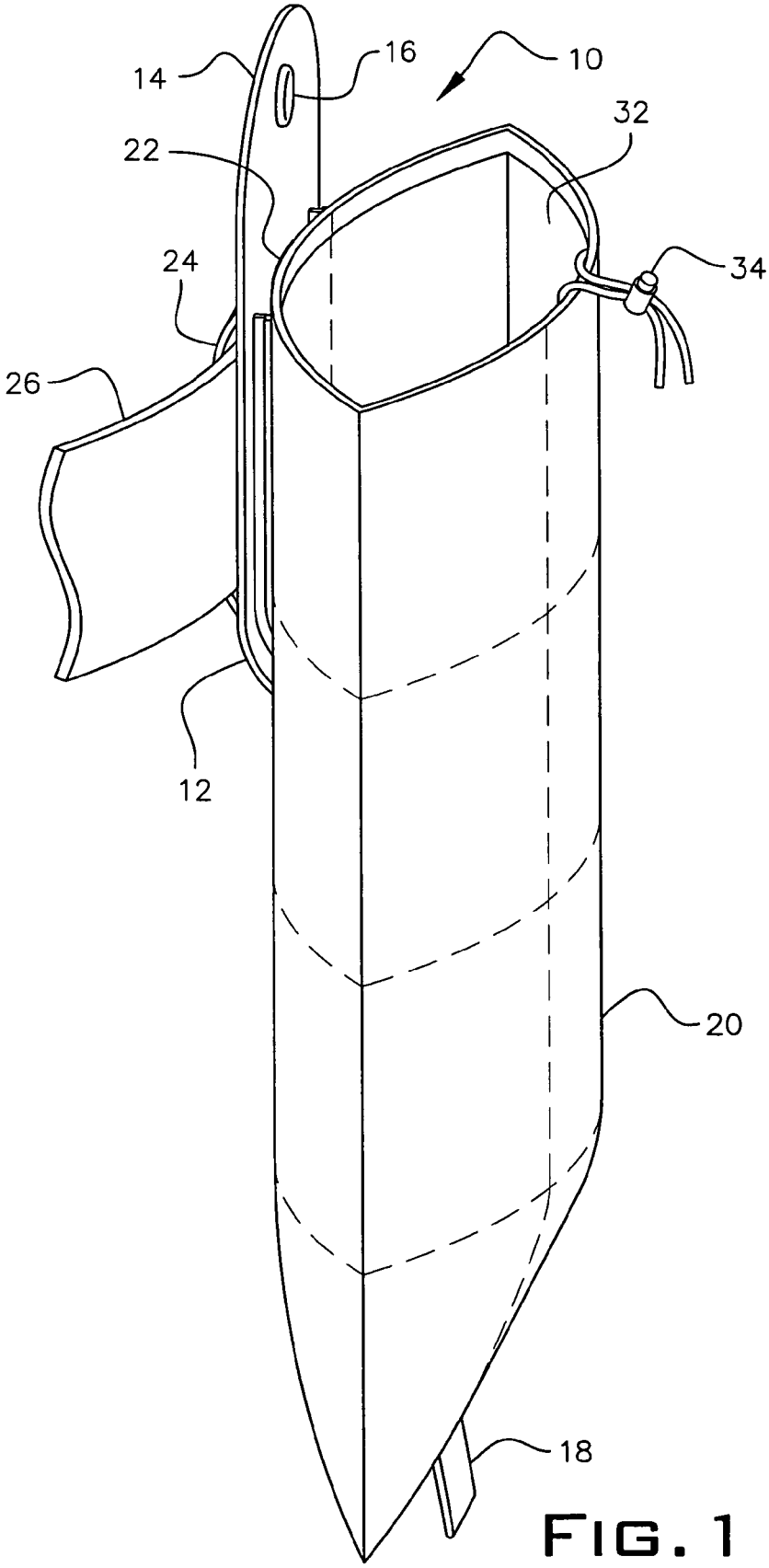
FIG. 1 is a perspective conceptual view of the present invention with the inner bag deployed.
Figure 2B:
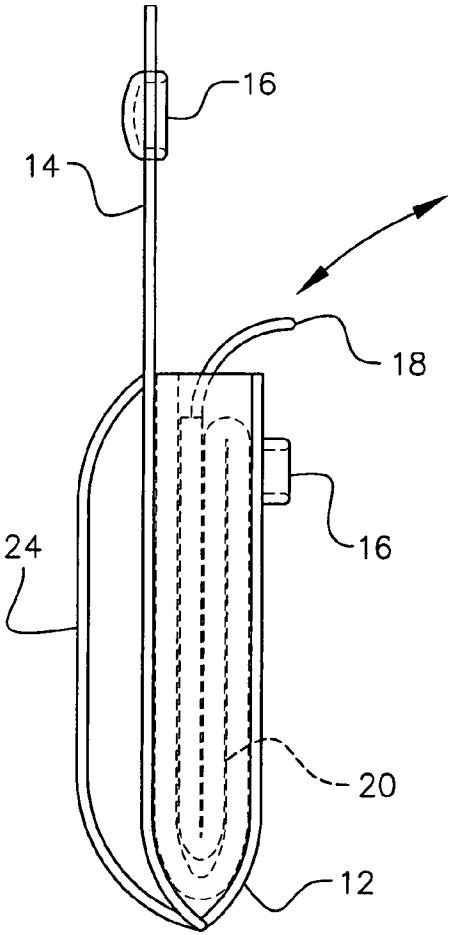
FIG. 2B is a perspective conceptual depiction of the invention with the outer flap in an open position to deploy the inner bag.
Figure 2A:
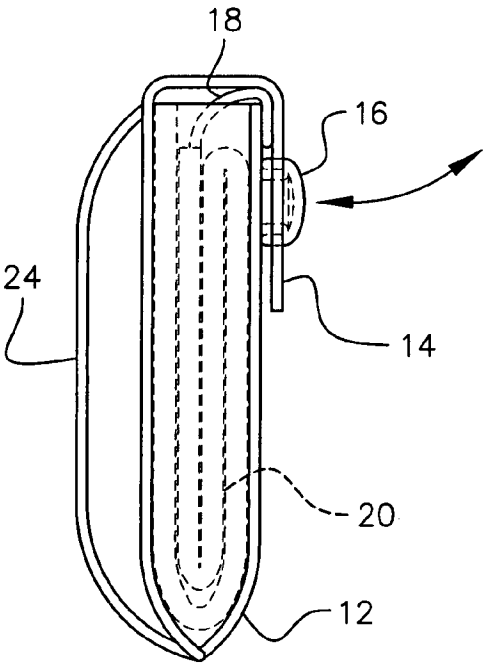
FIG. 2A is a perspective conceptual depiction of the invention in a closed secure position.
Figure 2C:
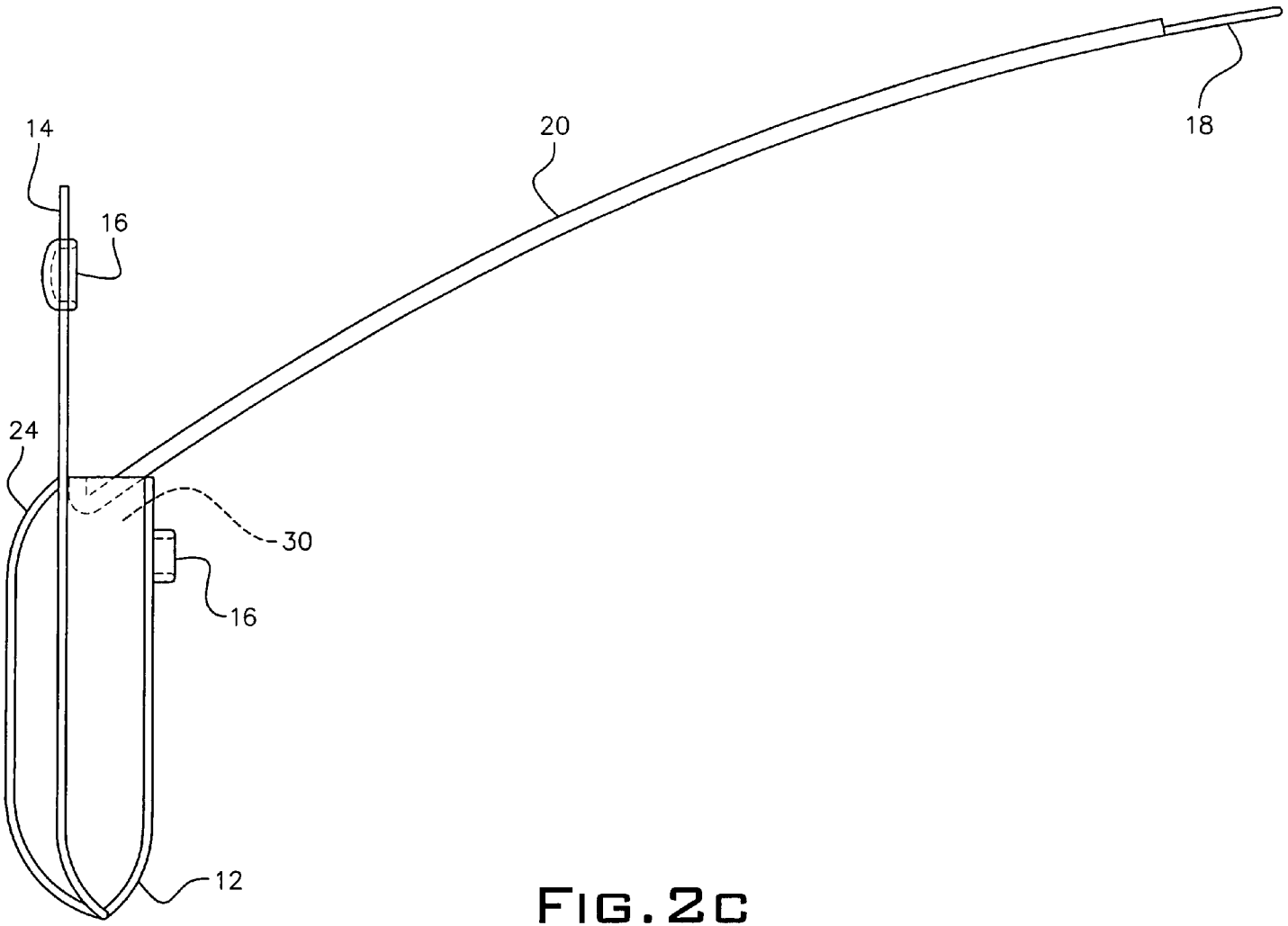
FIG. 2C is a perspective conceptual depiction of the invention with the outer flap in an open position and the inner bag partial deployed.

Referring now to the drawings, FIGS. 1 and 2A-2C disclose one embodiment of the present invention, which is a property and evidence bag for use during a process of arresting or detaining a prisoner, depicted generally as 10.

The property and evidence bag 10 comprises an outer container 12 having an opening at its top to an interior chamber 30. The outer container 12 includes means 24 on its back side for securement to an officer wearing the property and evidence bag 10. This can be in the form of a belt loop as depicted by example only, in the drawings. For example, in lieu of attaching to a belt, the loop could be rotated so that the evidence bag 10 instead attaches to a should strap or harness. Other securement means known in the art could be hook and loop fasteners or snap buttons, or simply fastening by sewing, for example, the outer container 12 to a portion of the uniform or gear worn by the police officer. The belt loop shown in the drawings is merely a depiction, by example, of a preferred method of attachment to the police officer.

The outer container 12 has an extended flap securement portion 14 that extends from its back side and is of sufficient length and width to cover the opening at the top of the interior chamber 30 and secure to a front side of the outer container 12. The flap portion 14 includes means 16 for securing the extended flap securement portion to the front side of the outer container 12. This can be in the form of snap buttons such as those depicted by example only. Of course, other methods known in the art may be used for this purpose, such as, hook and loop fasteners, swivel clips such as those used on cuff links, etc. The snap buttons are preferred to allow for quick opening of the container 12 and for maintaining the cleanliness of the container 12.

The invention 10 has a foldable interior bag 20 with an opening at its top portion for access to an interior property and evidence collection chamber 32 formed by the foldable interior bag 20 when in its deployed position. A portion of the foldable interior bag 20 near its opening is attached to the outer container 12 near the top of its interior chamber 30 as depicted by attachment location 22. This can be done by sewing, heat welding or gluing the bag 20 to the back side interior of bag 12 near the base of flap 14 as shown in the drawings by example, or by attachment to the front side interior of bag 12 (not shown) using similar methods.

The foldable interior bag 20 further includes means 18 for manually deploying the foldable interior bag 20 from the outer container 12. The preferred means 18 for manually deploying the foldable interior bag 20 from the outer container 12 is a pull tab attached approximate the bottom of the foldable interior bag 20. Typically, the bag 20 is folded and inserted in the container 12 so that when the flap 14 is opened, the pull tab is accessible at the top of the packed inner bag 20 and can be readily grabbed and pulled to deploy the inner bag 20. Although a pull tab is depicted in the drawings, the pull tab is only an example of such a device to enable the deploying of the inner bag 20. A string could be used as well, for example. The inner bag 20 includes means 34 for securing the opening of the foldable interior bag 20 after property and evidence has been placed therein.

As shown in the deployed position of FIG. 1, the foldable interior bag 20 is configured so that when it is deployed, it expands both in width and depth to be greater than a respective width and depth of the outer container 12.

The outer container 12 can be made from a variety of materials that can blend in and be part of the uniform worn by the police office. It can be made from material that includes fabric material, plastic or polymeric-based material, metal material, vinyl material, nylon material, leather material or any combination of these.

The foldable interior bag 20 can be made from any flexible and foldable material that can be compactly folded and inserted into the outer bag 12. Such materials include vinyl material, nylon material, fabric material, polymer-based fabric material, or any combination thereof.

Either the outer container 12 of the inner bag 20 can optionally be made from a waterproof material or treated to be waterproof by ways known in the art.

The preferred means for securing the opening of the foldable interior bag after property and evidence has been placed therein is a draw-string 34. The depicted preferred embodiment includes a slidable locking/tightening device, which is well known in the art to be associated with such closure draw strings. The latter serves as means for locking the draw-string in its drawn-tight position.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A property and evidence bag consisting of:

an outer container having a front panel, a back panel, and an opening at its top to an interior chamber;

the outer container having belt loop means for securement to an officer wearing the property and evidence bag, said belt loop means being fixed to a back side of said outer container and extending generally from an approximate bottom of said outer bag to an approximate top of said outer bag;

the outer container having an extended flap securement portion that extends from its back side above said belt loop means and is of sufficient length and width to cover the opening at the top of the interior chamber and secure to a front side of the outer container;

means for securing the extended flap securement portion to the front side of the outer container;

a foldable interior bag having a front panel, a back panel, and an opening at its top portion for access to an interior property and evidence collection chamber formed by the foldable interior bag when in its deployed position, the back panel of the foldable interior bag near its opening being permanently sewn, heat welded or clued directly on to the back panel of the outer container at an attachment location near the top of the interior chamber at an approximate center portion of a backside side of said respective outer container and foldable interior bag, the foldable interior bag further having means attached to a bottom of said foldable interior bag for manually deploying the foldable interior bag from the outer container, wherein said foldable interior bag is expandable and when said foldable interior bag is deployed and expanded for use outside the interior chamber confines of said outer container, said foldable interior bag has a width wider than a corresponding width of said outer container and a significantly longer depth of at least twice a corresponding depth of said outer container so as to provide an internal volume significantly larger than a corresponding interior volume formed by said outer container; and means for securing the opening of the foldable interior bag after property and evidence to be preserved for eventual itemizing by said officer has been placed therein, wherein said means for manually deploying the foldable interior bag for use and said means for securing said opening of said foldable interior bag after placement therein of said property and evidence are configured to be manipulated with the use of one hand.

2. The property and evidence bag according to claim 1, wherein the means for manually deploying the foldable interior bag from the outer container is a pull tab.

3. The property and evidence bag according to claim 1, wherein the outer container is made from material comprising one of fabric material, polymeric material, metal material, vinyl material, nylon material, leather material or any combination thereof.

4. The property and evidence bag according to claim 1, wherein the foldable interior bag is made from material comprising vinyl material, nylon material, fabric material, polymer-based fabric material, waterproof material or any combination thereof.

5. The property and evidence bag according to claim 1, wherein the means for securing the opening of the foldable interior bag after property and evidence has been placed therein is a draw-string.

6. The property and evidence bag according to claim 5, wherein the draw-string further comprises a locking/tightening device serving as means for locking the draw-string in its drawn-tight position.

* * * * *